United States Patent [19]

Patterson et al.

[11] Patent Number: 4,975,992

[45] Date of Patent: Dec. 11, 1990

[54] PORTABLE SHOWER STALL

[76] Inventors: James Patterson; Julia H. Patterson, both of 2695 Calle Quebrada, San Diego, Calif. 92139

[21] Appl. No.: 428,939

[22] Filed: Oct. 30, 1989

[51] Int. Cl.[5] ..... A47K 3/23

[52] U.S. Cl. ..... 4/599; 4/603; 4/605; 4/613

[58] Field of Search ..... 4/596, 599, 603, 605, 4/608, 610, 613; 417/405, 406, 407, 408, 409

[56] References Cited

U.S. PATENT DOCUMENTS

| | | | |
|---|---|---|---|
| 15,597 | 8/1856 | Ariail | 417/407 |
| 477,515 | 6/1892 | Cox et al. | 4/599 |
| 1,017,167 | 2/1912 | Pleins | 4/613 |
| 1,764,259 | 6/1930 | Hansen | 417/405 |
| 2,236,376 | 3/1941 | McClendon | 4/605 |
| 2,634,425 | 4/1953 | Sturwold | 4/599 |
| 3,080,568 | 3/1963 | Burnett | 4/599 X |
| 3,590,398 | 7/1971 | Jetter | 4/599 |
| 3,800,335 | 4/1974 | Buonaura | 4/613 |
| 4,064,570 | 12/1977 | Kim | 4/603 X |
| 4,413,363 | 11/1983 | Troiano | 4/599 |
| 4,437,484 | 3/1984 | Laing et al. | 417/404 X |

FOREIGN PATENT DOCUMENTS

| | | | |
|---|---|---|---|
| 1291483 | 3/1969 | Fed. Rep. of Germany | 4/599 |
| 12547 | of 1915 | United Kingdom | 4/599 |

*Primary Examiner*—Ernest G. Cusick
*Assistant Examiner*—Robert M. Fetsuga
*Attorney, Agent, or Firm*—Ralph S. Branscomb

[57] ABSTRACT

A portable shower stall is provided having a ceiling and a base which clamshell together to define a suitcase-like enclosure enclosing all of the support, curtain and hose structure for transport when not in use, and expandable to a full height, fully enclosed shower stall. The shower stall may be installed near any sink or other water outlet, and in the preferred embodiment, water is removed from the base by means of a sump pump which is driven by a water motor powered by incoming water used for the shower head.

1 Claim, 2 Drawing Sheets

PORTABLE SHOWER STALL

BACKGROUND OF THE INVENTION

The invention is in the field of portable sanitary devices and, in particular, pertains to a portable shower stall.

There is many a time when a weary traveler wishes to take a shower and no shower is available. This, of course, true of business travelers, and is also true of recreational travelers.

Vacationers who travel in recreational vehicles or campers must make a fairly important decision before they purchase their vehicle. This decision is whether the vehicle will be a small, maneuverable and fuel-economical vehicle, such as a pop-top camper, or a large, completely self-contained vehicle which has a toilet and a shower contained within it. When moving from a smaller vehicle, such as a VW Westphalia to a large Winnebago-like structure, one of the major differences is the provision of a large holding tank for toilet and shower water. This adds considerably to the weight of the vehicle, thus diminishing fuel economy and increasing the cost of all of the support structure, as well as the plumbing for the recreational vehicle.

Of course, the drawback of a small vehicle is that it has no shower or toilet. The kitchen area, however, is provided, and is relatively compact, lightweight, and does not significantly decrease the fuel mileage of the vehicle or increase the weight.

Whereas the traveler has relatively little difficulty finding toilets along the route, in service stations and restaurants, showering is a different matter. One cannot pull into a restaurant and take a shower. This one instance in which a portable shower would be very desirable, although there are clearly many other situations, and other types of travelers who would benefit greatly from a collapsible, totally portable, shower stall.

SUMMARY OF THE INVENTION

The instant invention is a collapsible, totally portable, shower stall, which can be connected to any available water supply with an associated drain. It comprises a ceiling panel and a base panel which clamshell together to define a suitcase-like enclosure which includes the support posts, curtain, sump pump, shower head, and associated hoses, when the invention is packed into its portable mode. To use the invention as a shower, the suitcaselike enclosure is placed on the floor or ground with the base down, and the ceiling panel is raised, with corner supports put in place, with the shower curtain then engaged around the periphery of the ceiling and floor panels to define a shower enclosure. Appropriate hoses are then connected to a hot and cold water supply and to a drain area, with the hoses connecting to a water motor driven sump pump which supplies the shower head, with the water power to the shower head powering the pump which evacuates drain water from the basin defined by the base panel.

DETAILED DESCRIPTION OF THE PREFERRED EMBODIMENT

The shower stall in its expanded mode is illustrated at 10. It is comprised of a base panel 12, a ceiling panel 14, segmented support poles 16, a surrounding shower curtain 18, and a water supply and evacuation system described below.

Figure 2:
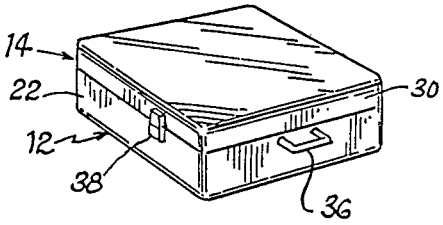
FIG. 2 is an isometric view of the portable shower stall in its collapsed, portable mode.
Figure 5:
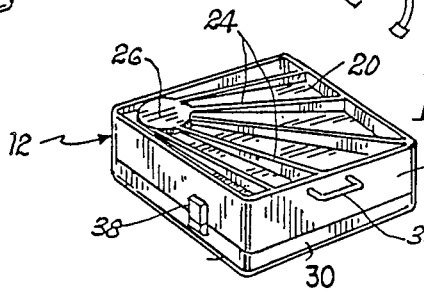
FIG. 5 is an isometric view of the bottom of the shower stall when in its portable mode.
Figure 6:
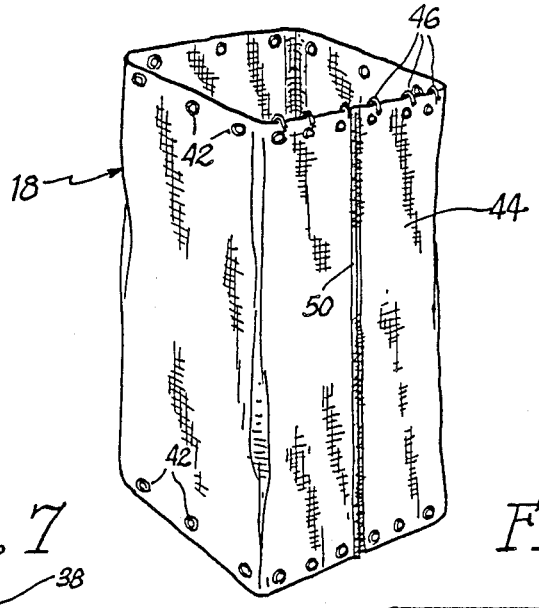
FIG. 6 illustrates the shower curtain in isolation as it would appear in use.
Figure 7:
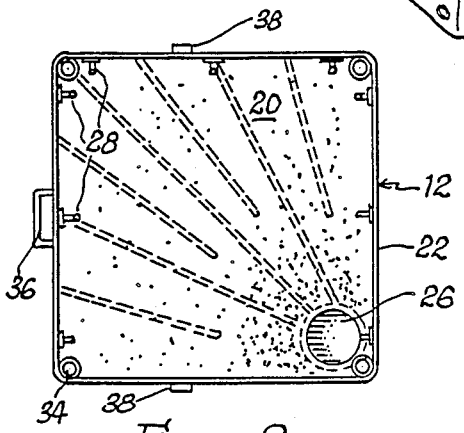
FIG. 7 is a top plan view of the base panel/basin.
Figure 9:
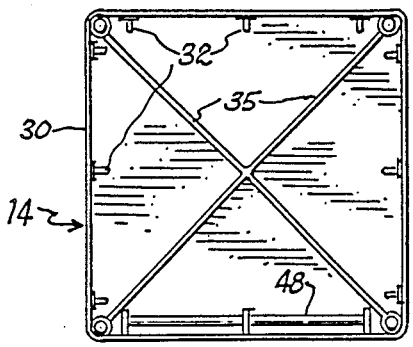
FIG. 9 is a plan view of the underside of the ceiling panel.
Figure 8:
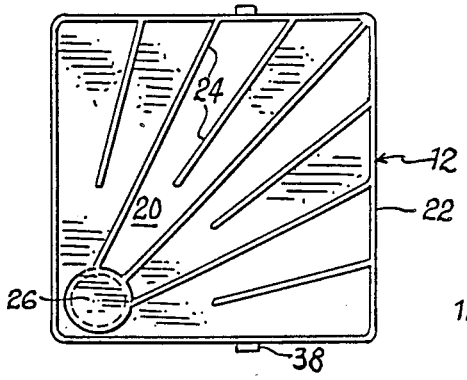
FIG. 8 is a bottom plan view of the panel/basin.

The base panel 12 of the shower stall acts as both one side of the suitcase-like enclosure shown in FIG. 2 when the stall is collapsed, and as a basin when the shower is in use. It has a flat, floor area 20 with a peripheral flange about six inches deep indicated at 22 to define a basin. The floor is supported by inclined ribs 24 on its bottom, best shown in FIG. 5, so that it slopes down to one corner where a sump 26, which is actually just a pump mounting depression, is defined. The interior of the upright flange 22 mounts or defines a series of spaced hooks 28.

The ceiling panel 14 similarly has a peripheral flange 30 and mounts a series of spaced hooks 32. Both panels are rectangular, being square in the illustrated embodiment, and define a socket 34 in each corner. Diagonal cross ribs 35 traverse the ceiling panel 14. The bottom panel having a wider flange, mounts a carrying handle 36, and latch means, such as suitcase latches 38 are provided to hold the panels together for transport.

Some type of collapsible support means is required to support the ceiling panels spaced above the base panel so that the shower enclosure can be defined. Obviously, these supports must be collapsible in some fashion so that they will fit in the suitcase enclosure for transport. The poles could be telescoping, have knuckle-type bending joints in them, or in any other fashion be designed such that they have a rigid mode extending at least six feet from end to end, and a collapsed mode in which they extend less than four feet. The planform dimensions of the panels are 3 feet by 3 feet in the preferred embodiment, yielding diagonal dimensions of just over four feet, so that poles collapsible down to lengths no more than four feet would function adequately.

In the preferred embodiment, the poles are segmented, each joint whereby they could be made into their full length, and at the ends they engage in the sockets 34. This is clearly visualized from FIG. 3.

The curtain 18 is made of a lightweight waterproof material, such as nylon. In the preferred embodiment, it has a series of spaced eyelets or grommets 42 around both its upper and lower edges, and these eyelets engage on the hooks 28 and 32 so that fairly taught sidewalls are provided by the curtain. The front 44 of the curtain is preferably where the two vertical edges of the curtain meet, and the curtain adjacent these edges are provided with curtain hooks 46 so that the curtain slides on the curtain rod 48, which is built into the underside of the ceiling panel adjacent the front edge. In the preferred embodiment, the two vertical edges of the curtain which meet are provided with a zipper closure 50.

Figure 1:
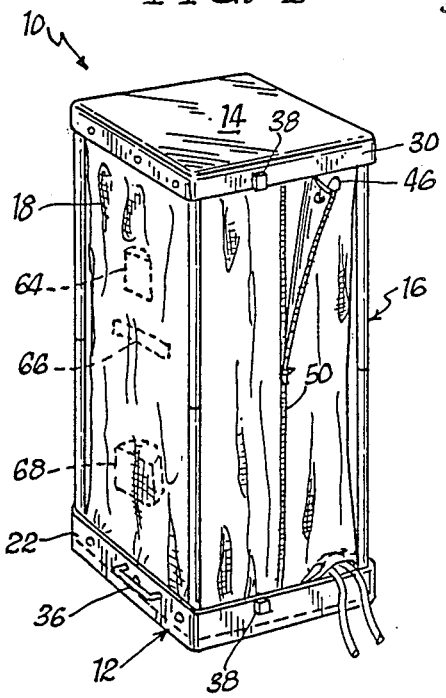
FIG. 1 is an isometric view of the portable shower stall in its shower mode.
Figure 4:
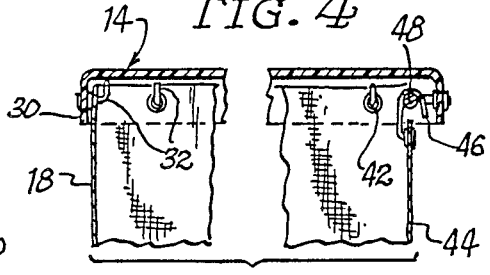
FIG. 4 is a detail illustrating the hooks and curtain rods defined on the interior of the ceiling panel.
Figure 3:
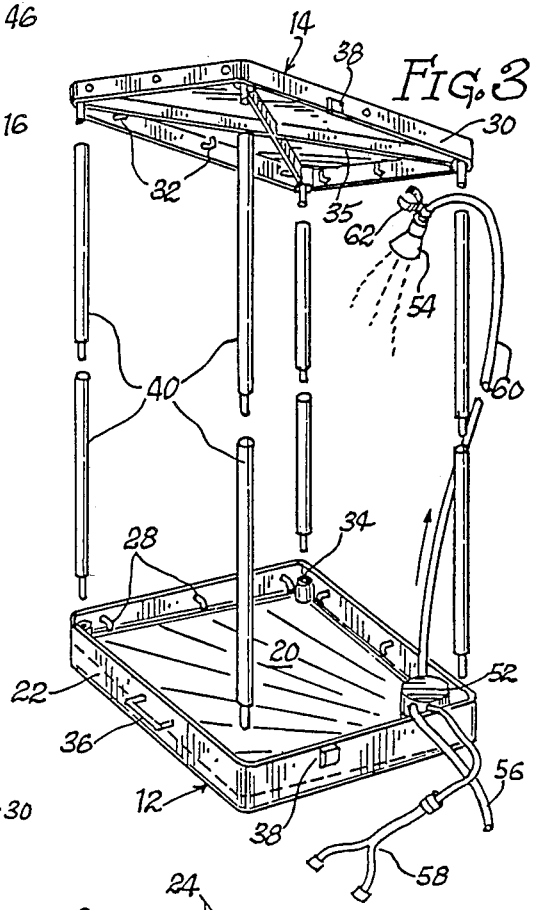
FIG. 3 is an exploded view of the shower stall with the curtain removed and the support pole segments separated.
Figure 10:
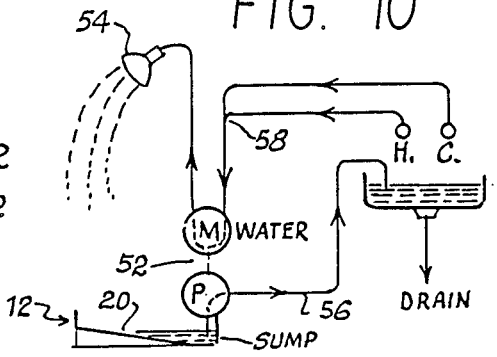
FIG. 10 is a diagrammatic illustration of the water flow through the shower stall.

The water supply system is shown best in FIGS. 3 and 10. At its heart is a combined pump and motor 52 that rests in the sump depression 26. Clearly, the pump could be mounted, although there may not be any need to permanently mount it, and cleaning is easier if it is removable and simply rests in the depression defined in the basin.

Although the motor could be electric, it is more desirable that it be a water motor, such that the incoming water pressure from the water supply passes through the motor/pump on its way to the shower head 54, driving the sump pump which pumps the accumulated water from the basin out through the drain hose 56 to the ground, or to a suitable drain.

In the illustrated embodiment, a very simple water supply system is provided for the invention wherein a Y 58 connects to the hot and cold water faucets. This Y is removable, in the case where a single spigot provides both hot and cold water in mixed form, and no doubt several different types of spigots. In the illustrated embodiment, the water temperature would have to be established before one enters the shower, and could be changed only by accessing the external spigots. This has the advantage of simplifying the plumbing considerably, and eliminating the need for some type of hot and cold water valve inside the enclosure.

The shower head 54 is connected to the motor/pump through a hose 60. The shower head has a mounting bracket or clip 62 which may be used to connect to one of the ceiling hooks 32, or some specialized structure that might be provided in the ceiling specifically for this purpose.

For further convenience of the user, the shower curtain may be provided with a soap pocket 64, which could be made of cloth mesh to facilitate draining, a strap 66 for a wash cloth, and another pocket 68 for shampoo and hair conditioner, etc. Other miscellaneous pockets could be added for holding other items.

The invention is thus a complete, portable shower, that can be used anywhere there is a supply of water under pressure, and a drain, or a ground area where the water can be drained. By acquiring such a portable shower, vacationers are freed from reliance on either motels, or fully enclosed recreational vehicles which cost around $40,000 at the time of this writing. It could also be a boon to business travelers, who might stop at a rest area outside of town, and take a quick shower before going into town for a business appointment. Its dimensions are small enough that it can conveniently fit in a trunk, or in a roof rack, or virtually anywhere in a small camper or recreational vehicle to significantly facilitate and expedite the journey of the traveler.

I claim:

1. A portable shower stall comprising:

(a) a ceiling panel;

(b) a base panel having an upright peripheral flange to define a basin;

(c) said panels having platform dimensions such that they will clamshell together to define a compartment, and including latch means for releasibly holding said panels together;

(d) collapsible supports for supporting said ceiling panel spaced far enough said base panel that a standing person will fit beneath said ceiling panel while standing on said base panel;

(e) said supports being dimensioned such that when collapsed, they will fit within said compartment;

(f) a curtain dimensioned to substantially span between said panels around the peripheries thereof to define a shower enclosure;

(g) a shower head;

(h) hose means for connecting said shower head to a water source, and water removal means for removing water from said basin;

(i) said compartment being of sufficiently large dimensions to contain said hose means, water removal means, collapsible supports and curtain, when clamshelled together (j) said base panel defining a mount for said water removal means, and said water removal means comprising a sump pump;

(k) said sump pump being removable from said mount and being driven by a water motor powered by water provided to said shower head, wherein said hose means for connecting said shower head passes through said motor to power same such that substantially all of the water to power said motor is delivered to said shower head, and said pump is connected to a drain for emptying into a sink drain.

* * * * *